US007915526B2

(12) United States Patent
Fagrell et al.

(10) Patent No.: US 7,915,526 B2
(45) Date of Patent: Mar. 29, 2011

(54) COAXIAL CABLE COMPRISING DIELECTRIC MATERIAL

(75) Inventors: Ola Fagrell, Stenungsund (SE); Ulf Nilsson, Stenungsund (SE)

(73) Assignee: Borealis Technology Oy, Provoo (FI)

( * ) Notice: Subject to any disclaimer, the term of this patent is extended or adjusted under 35 U.S.C. 154(b) by 685 days.

(21) Appl. No.: 10/538,327

(22) PCT Filed: Oct. 27, 2003

(86) PCT No.: PCT/EP03/11905

§ 371 (c)(1),
(2), (4) Date: Mar. 10, 2006

(87) PCT Pub. No.: WO2004/053895

PCT Pub. Date: Jun. 24, 2004

(65) Prior Publication Data

US 2006/0219425 A1 Oct. 5, 2006

(30) Foreign Application Priority Data

Dec. 12, 2002 (EP) ..... 02027860

(51) Int. Cl.
*H01B 7/00* (2006.01)

(52) U.S. Cl. ..... 174/28; 428/375; 428/379; 428/383; 174/110 PM; 174/102 R; 525/240

(58) Field of Classification Search ..... 428/375, 428/379, 383
See application file for complete search history.

(56) References Cited

U.S. PATENT DOCUMENTS

| | | | | |
|---|---|---|---|---|
| 3,968,463 | A | 7/1976 | Boysen | |
| 5,047,446 | A * | 9/1991 | DeNicola, Jr. | 522/157 |
| 5,047,485 | A | 9/1991 | DeNicola, Jr. | |
| 6,094,337 | A | 7/2000 | Ueda et al. | |
| 6,121,335 | A | 9/2000 | Higashikubo et al. | |
| 6,130,385 | A | 10/2000 | Tuunanen et al. | |
| 6,599,626 | B1 | 7/2003 | Cogen et al. | |
| 2004/0242716 | A1 * | 12/2004 | Motha et al. | 521/142 |
| 2006/0219425 | A1 * | 10/2006 | Fagrell et al. | 174/110 PM |

FOREIGN PATENT DOCUMENTS

| | | | |
|---|---|---|---|
| CH | 357096 | | 9/1961 |
| DE | 1 465 640 | | 11/1969 |
| EP | 0 190 889 | A2 | 8/1986 |
| EP | 0 384 431 | A2 | 8/1990 |
| EP | 0634454 | A1 * | 1/1995 |
| EP | 0 885 918 | A1 | 12/1998 |
| EP | 0 961 295 | A1 | 12/1999 |
| EP | 1429346 | A1 * | 6/2004 |

* cited by examiner

*Primary Examiner* — Jill Gray
(74) *Attorney, Agent, or Firm* — Roberts Mlotkowski Safran & Cole, P.C.

(57) ABSTRACT

The present invention relates to a coaxial cable comprising a dielectric layer which comprises as a component (A) a propylene homo- or copolymer having strain hardening behaviour and to the use of propylene homo- or copolymer having strain hardening behaviour for the production of a dielectric layer of a coaxial or triaxial cable.

9 Claims, 3 Drawing Sheets

COAXIAL CABLE COMPRISING DIELECTRIC MATERIAL

The present invention relates to a coaxial or triaxial cable, in particular to a coaxial high radio frequency cable, comprising a dielectric layer, and to a dielectric material for use in a coaxial or triaxial cable.

A coaxial cable is defined to comprise one centre conductor and one outer concentric conductor and a triaxial cable is defined to comprise one centre conductor and two outer concentric conductors with an isolating layer separating them. Usually, these cables are protected with an outermost jacket.

In the following, where reference is made to coaxial cables also triaxial cables should be included.

In a coaxial cable the diameter of the dielectric material is typically above 1 mm. In radio frequency cables the diameter of the dielectric usually varies between 4 mm and 52 mm.

For the transfer of radio frequency signals e.g. in antenna systems of base stations of mobile phone networks, the use of coaxial cables is common in the art.

Typically, radio frequency coaxial cables are used as feeder or radiating cables. Feeder cables are used in the high power transmission from the power amplifier stage of a radio transmitter to the radiating antenna element or connection of a receiving antenna to the input stage of a radio receiver, or a combination of similar signal paths. An example of such an application is found at the base stations of mobile phone networks. Another application is in the radio shadow areas of said mobile phone systems such as tunnels, cellars, etc., where this type of cable can be used as the radiating element when provided with a perforated leaky outer conductor. The coaxial cables are useful also in community antenna television (CATV) systems in which the transmitted signal conveys both analogue and digital television pictures, as well as on the subscriber lines of modern telephone systems (access networks) which use coaxial cables as the transmission medium in the transfer of wideband information.

A typical coaxial cable comprises an inner conductor made of copper or aluminium, a dielectric insulation layer made of a polymeric material, and an outer conductors made of copper or aluminium (see FIG. 1). Examples of outer conductors are metallic screens, foils or braids. Furthermore, in particular when polyethylene is used for the dielectric layer, the coaxial cable comprises a skin layer between the inner conductor and the dielectric layer to improve adherence between inner conductor and dielectric layer and thus improve mechanical integrity of the cable.

An important requirement for the dielectric layer of coaxial cables is that the attenuation of the signal should be as small as possible. Therefore, today said polymeric dielectric layer, typically polyethylene, is usually expanded by chemical or physical foaming to a level of up to 75 vol % or more.

However, due to the high degree of expansion typically used it is required for high frequency RF communications that the polymeric material used for the dielectric layer shows superior mechanical properties for the melt upon expansion to obtain closed and even cell structure.

For example, from U.S. Pat. No. 6,130,385 it is known to use a blend of a low density polyethylene (LDPE) and medium density polyethylene (MDPE) for expandable dielectric layers of coaxial cables which shows good mechanical properties upon expansion. However, as today radio frequency cables tend to be used at ever increasing frequencies of up to several GHz it is a drawback of this dielectric layer material that the attenuation of the signals caused by the dielectric layer worsens with increasing frequency.

Furthermore, these cables have the disadvantage that the dielectric layer has to increase in thickness if the cable is used at higher frequencies and high power of the signal as required by the mobile phone networks of today and in future.

Accordingly, it is an object of the present invention to overcome the drawbacks of the above described techniques and to provide a coaxial or triaxial cable, especially for the transmission of high radio frequency signals, comprising a dielectric layer which is having a low attenuation, especially at higher radio frequencies and, at the same time, good mechanical properties of the melt so that a high degree of foaming can be achieved.

It has now surprisingly been found that such a coaxial or triaxial cable can be obtained if it comprises a dielectric layer which comprises polypropylene which has been modified in a particular way.

Accordingly, the present invention provides a coaxial and a triaxial cable comprising a dielectric layer which comprises as a component (A) a propylene homo- or copolymer having a strain hardening behaviour.

With the inventive cable the above-mentioned objects of the invention are achieved. In particular, the cable is showing an improved attenuation of the signal, especially at higher radio frequencies. It is believed that the improvement in attenuation is due to the particular behaviour of the so-called loss- or dissipation factor (tan δ) of the propylene homo- or copolymer used in the dielectric layer. This loss-factor has been found to be the most important influence factor for the attenuation behaviour of the dielectric layer.

The improved electrical properties of the inventive material enable higher operating frequencies and/or reduction in total cable thickness.

Due to the improved mechanical properties of the melt of the dielectric layer it is possible to obtain a high degree of expansion which also contributes to the good attenuation properties of the inventive cable.

It is a further advantage of the inventive cable that due to the improved mechanical properties of the dielectric layer a skin layer between the inner conductor and the dielectric layer can be omitted.

As polypropylene can withstand higher temperatures than polyethylene, the cable can be operated at a higher conductor temperature and therefore allows the transmission of signals with higher power rating and/or at higher frequencies.

The inventive cable can advantageously be used in all applications requiring the transfer of a radio frequency signal, especially at higher frequencies, whether digital or analogue. In particular, the cable can be used as feeder or radiating cable in mobile phone networks.

Propylene homo- and copolymers having strain hardening behaviour can be produced by a number of processes, e.g. by treatment of the unmodified propylene polymer with thermally decomposing radical-forming agents and/or by treatment with ionising radiation, where both treatments may optionally be accompanied or followed by a treatment with bi- or multifutnctionally unsaturated monomers, e.g. butadiene, isoprene, dimethylbutadiene or divinylbenzene.

Further processes may be suitable for the production of the modified propylene polymer, provided that the resulting modified propylene polymer meets the characteristics of strain hardening behaviour, which is defined in the Examples Section below.

Examples of said modified propylene polymers showing strain hardening behaviour are, in particular:

- polypropylenes modified by the reaction of polypropylenes with bismaleinmido compounds in the melt as e.g. described in EP 0 574 801 and EP 0 574 804, polypropylenes modified by the treatment of polypropylenes with ionising radiation in the solid phase as e.g. described in EP 0 190 889 and EP 0 634 454, polypropylenes modified by the treatment of polypropylenes with peroxides in the solid phase, see e.g. EP 0 384 431, or in the melt, see e.g. EP 0 142 724, polypropylenes modified by the treatment of polypropylenes with multifunctional, ethylenically unsaturated monomers under the action of ionising radiation as described e.g. in EP 0 678 527, polypropylenes modified by the treatment of polypropylenes with multifunctional, ethylenically unsaturated monomers in the presence of peroxides in the melt as described e.g. in EP 0 688 817 and EP 0 450 342.

The modified propylene polymers having strain hardening behaviour are preferably prepared by a) mixing a particulate unmodified propylene polymer, which comprises a1) propylene homopolymers, preferably propylene homopolymers with a weight average molecular weight Mw of 500,000 to 1,500,000 g/mol, and/or a2) copolymers of propylene and ethylene and/or alpha-olefins with 4 to 18 carbon atoms, or of mixtures of such copolymers, with from 0.05 to 3 wt %, based on the polyolefin composition used, of acyl peroxides, alkyl peroxides, hydroperoxides, peresters and/or peroxycarbonates as free-radical generators capable of thermal decomposition, if desired diluted with inert solvents, with heating to 30-100° C., preferably to 60-90° C., b) sorption of bifunctional unsaturated monomers by the particulate propylene polymer at a temperature T (° C.) of from 20 to 120° C., preferably of from 60 to 100° C., where the amount of the absorbed bifunctional unsaturated monomers is from 0.01 to 10 wt %, preferably from 0.05 to 2 wt %, based on the propylene used, and then c) heating and melting the particulate polyolefin composition in an atmosphere comprising inert gas and/or the volatile bifunctional monomers, from sorption temperature to 210° C., whereupon the free-radical generators capable of thermal decomposition are decomposed and then d) heating the melt of to 280° C. in order to remove unreacted monomers and decomposition products, e) agglomerating the melt in a manner known per se.

Usual amounts of auxiliary substances, which may range from 0.01 to 1.5 wt % of stabilizers, 0.01 to 1 wt % of processing aids, 0.1 to 1 wt % of antistatic agents, 0.2 to 3 wt % of pigments and up to 3 wt % of alpha-nucleating agents, in each case based on the sum of the propylene polymers, may be added before step a) and/or e) of the method and/or before or during step c) and/or d) of the above described method.

The particulate unmodified propylene polymer may have the shape of powders, granules or grit with grain sizes ranging from 0.001 mm up to 7 mm.

The process for producing the modified propylene polymer preferably is a continuous method, performed in continuous reactors, mixers kneaders and extruders. Batchwise production of the modified propylene polymer, however is feasible as well.

Preferably volatile bifunctional monomers are absorbed by the particulate propylene polymer from the gas phase.

Practical sorption times $\tau$ of the volatile bifunctional monomers range from 10 to 1000 s, where sorption times $\tau$ of 60 to 600 s are preferred.

The bifunctional unsaturated monomers, which are used in the process for producing the modified propylene polymers preferably are $C_4$- to $C_{10}$-dienes and/or $C_7$- to $C_{10}$-divinyl compounds. Especially preferred are butadiene, isoprene, dimethyl-butadiene or divinylbenzene.

Preferably, the propylene homo- or copolymer having strain hardening behaviour has a melt flow rate of 0.1 to 25 g/10 min at 230° C./2.16 kg.

In a preferred embodiment of the present invention, the dielectric layer of the coaxial cable further comprises as a component (B) a medium or high density ethylene homo- or copolymer and/or a non-strain hardening behaviour propylene homo- or copolymer.

Medium density polyethylene typically has a density of 926 to 940 kg/m$^3$ according to ASTM D 1248, and high density polyethylene typically has a density of 940 to 960 kg/m$^3$.

If component (B) comprises polyethylene, it is preferred that it said polyethylene has medium density.

It is, however, preferred that component (B) comprises a non-strain hardening behaviour propylene homo- or copolymer, i.e. a polypropylene which after its production has not been modified to show strain hardening behaviour.

With the incorporation of said component (B) into the dielectric layer the mechanical properties and, in particular, the attenuation behaviour of said layer is further improved.

Further preferred, component (B) of the dielectric layer of the inventive coaxial cable comprises a clean-polypropylene.

Clean-polypropylene as used herein is defined to be a propylene homo- or copolymer, preferably a propylene homopolymer or ethylene copolymer having a catalyst residue less than 50 ppm, preferably less than 5 ppm, measured by ICP, an ash content below 100 ppm, preferably below 30 ppm, and a chloride content less than 5 ppm, preferably less than 1 ppm.

The catalyst residue is measured by determining of the amount of one or more elements present in the catalyst, usually A1, in a polypropylene sample by means of ICP, for example using a Plasma 40 Emission Spectrometer from Perkin-Elmer. Before the measurement, the polymer sample is brought into a soluble form, e.g. by careful burning of the sample at about 600° C., addition of $Li_2CO_3$ and NaJ, further heating to about 1000° C. and dissolving the cooled sample in nitric acid solution.

The ash content is determined by ashing a polypropylene sample at 1000° C. e.g. in a muffle furnace and weighing the rest.

The chloride content of a polypropylene sample is determined on the basis of X-ray fluorescence (XRF) spectrometry, e.g. by using an X-ray fluorescention Philips PW 2400.

Preferably, the clean-polypropylene is produced in a slurry process.

An example of clean-polypropylene as mentioned above is described, for example, in U.S. Pat. No. 5,252,389.

With the incorporation of clean-polypropylene into component (B) of the dielectric layer in particular the attenuation behaviour of said layer is still further improved.

It is preferred that component (B) of the dielectric layer comprises at least 50 wt % of clean-polypropylene.

In a further preferred embodiment, the ratio of components (A):(B) of the dielectric layer of the inventive coaxial cable is from 1:99 to 60:40, more preferably from 25:75 to 60:40.

Further preferred, the dielectric layer of the inventive coaxial cable has been expanded.

Expansion can be performed via chemical foaming in which the polymer raw material used for the dielectric layer is compounded with a chemical foaming agent which on decomposition blows closed cells of desired size into the dielectric layer. However, preferably expansion is achieved by physical foaming in which during extrusion of the dielectric material inert gas such as nitrogen, carbon dioxide or argon is injected to blow gas filled expanded cells.

It is preferred that the degree of expansion in the dielectric layer is at least 60 vol %, more preferred at least 75 vol % and most preferred between 77 and 85 vol %.

Furthermore, it is preferred that the dielectric layer of the inventive coaxial cable further comprises a nucleating agent, preferably in an amount of 0.01 to 0.05 wt %.

As the improved properties of the inventive coaxial cable in particular show up at higher radio frequencies it is preferred that the coaxial cable is used for the transmission of electromagnetic signals with a frequency of above 1 GHz, more preferably of above 1.5 GHz.

As mentioned, the present invention also relates to the use of propylene homo- or copolymer having strain hardening behaviour for the production of a dielectric layer of a coaxial cable.

BRIEF DESCRIPTION OF THE DRAWINGS

In the following the present invention will further be illustrated by means of examples with reference to the Figures.

EXAMPLES

1) Definition and Measurement of Strain Hardening Behaviour

Figure 1:
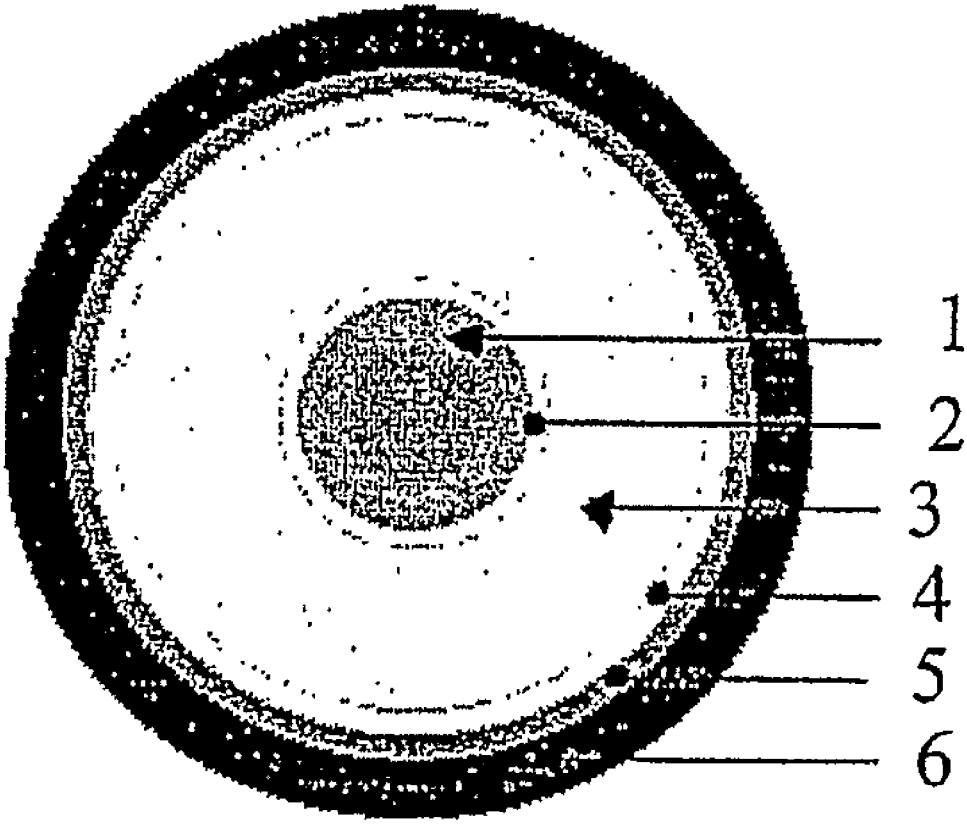
FIG. 1: shows a typical coaxial cable design comprising an inner conductor (1), an inner skin/adhesion layer (2), a foamed dielectric (3), an outer skin (4), an outer conductor (5) and a jacket (6)
Figure 2A:
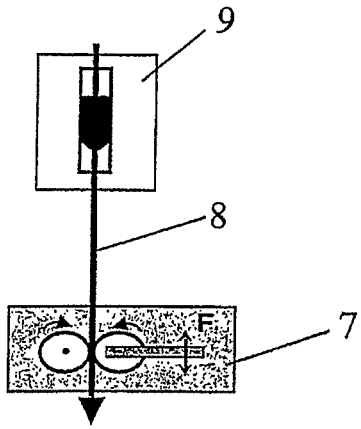
FIG. 2A shows a schematic drawing of the apparatus used for determining strain hardening behaviour.
Figure 2B:
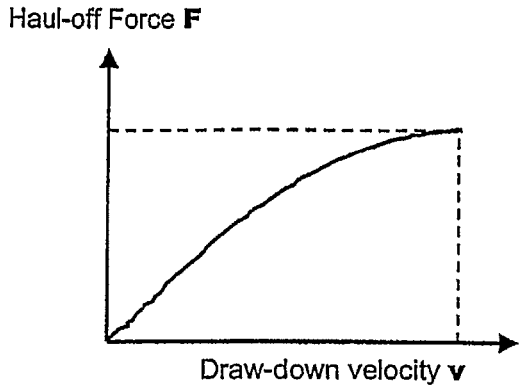
FIG. 2B shows a schematic diagram resulting from the measurement.
Figure 3:
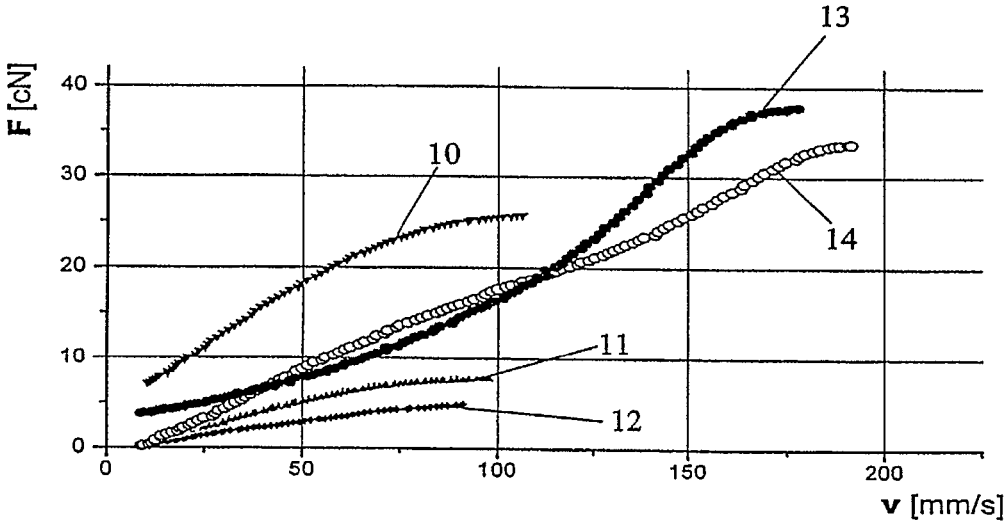
FIG. 3: shows a diagram showing recorded melt strength vs. drawability curves of different polymers with and without strain hardening behaviour.

The term "strain hardening behaviour" as used herein is defined according to FIGS. 2 and 3. FIG. 2 shows a schematic representation of the experimental procedure which is used to determine strain hardening.

The strain hardening behaviour of polymers is analysed by Rheotens apparatus 7 (product of Göttfert, Siemensstr. 2, 74711 Buchen, Germany) in which a melt strand 8 is elongated by drawing down with a defined acceleration. The haul-off force F in dependence of draw-down velocity v is recorded.

The test procedure is performed in a standard acclimatised room with controlled room temperature of T=23° C. The Rheotens apparatus 7 is combined with an extruder/melt pump 9 for continuous feeding of the melt strand 8. The extrusion temperature is 200° C.; a capillary die with a diameter of 2 mm and a length of 6 mm is used and the acceleration of the melt strand 8 drawn down is 120 mm/s$^2$.

The schematic diagram in FIG. 2 shows in an exemplary fashion the measured increase in haul-off force F (i.e. "melt strength") vs. the increase in draw-down velocity v (i.e. "drawability").

FIG. 3 shows the recorded curves of Rheotens measurements of polymer samples with and without strain hardening behaviour. The maximum points ($F_{max}$; $v_{max}$) at failure of the strand are characteristic for the strength and the drawability of the melt. The standard unmodified propylene polymers 10, 11 and 12 with melt flow rates of 0.3, 2.0 and 3.0 g/10 min at 230° C./2.16 kg, respectively, show a very low melt strength and low drawability. Accordingly, they have no strain hardening behaviour.

Modified propylene polymers 13 (melt flow rate of sample in diagram is 2 to 3 g/10 min at 230° C./2.16 kg) or LDPE 14 (melt flow rate of sample in diagram is 0.7 g/10 min at 230° C./2.16 kg) show a completely different melt strength vs. drawability behaviour:

With increasing the draw down velocity v the haul-off force F increases to a much higher level, compared to the standard propylene polymers 10, 11 and 12. This curve shape is characteristic for strain hardening behaviour. While polymers 10 and 11 show haul-off $F_{max}$ larger than 5 cN, they do not have strain hardening behaviour because they do not have draw-down velocities $v_{max}$ larger than 150 mm/s.

Accordingly, propylene polymers which have strain hardening behaviour as used herein have enhanced strength with haul-off forces $F_{max}$>5 cN and enhanced drawability with draw-down velocities $v_{max}$>150 mm/s.

2) Synthesis of Propylene Homopolymer with Strain Hardening Behaviour

A powdery polypropylene homopolymer, with a melt index of 0.25 g/10 min at 230° C./2.16 kg and an average particle size of 0.45 mm, is metered continuously into a continuous mixer. Furthermore, 0.45 wt % based on the propylene homopolymer of tert.-butyl peroxybenzoate as thermally decomposing free radical forming agent is metered into the mixer. While being mixed homogeneously at 50° C., the propylene homopolymer containing the tert.-butyl peroxybenzoate is charged absorptively during a residence time of 7 minutes at 50° C. by means of a mixture of butadiene and nitrogen with 0.135 wt % of butadiene, based on the polypropylene homopolymer. After transfer to a twin screw extruder, the powdery reaction mixture, in contact with the mixture of butadiene and nitrogen, with which it has been charged, is melted at a mass temperature of 230° C. and, after a coarse degassing, subjected to a fine degassing with addition of water as an entraining agent, an additive mixture of 0.1 wt % of tetrakis-(methylene-(3,5-di-t-butylhydroxycinnamate)-methane, 0.1 wt % of tris-(2,4-di-t-butylphenyl)-phosphite), 0.1 wt % of pentaerythritol tetrakis-3-(3,5-di-t-butyl-4-hydroxyphenyl)-propionate and 0.1 wt % of calcium stearate is added to the melt. After distribution of additives the melt is discharged and granulated.

The resulting, modified propylene polymer MPP shows strain hardening behaviour characterized by the Rheotens values of $F_{max}$=38 cN and $v_{max}$=175 mm/s measured at failure of the strand and a melt index of 2.3 g/10 min at 230° C./2.16 kg.

Figure 4:
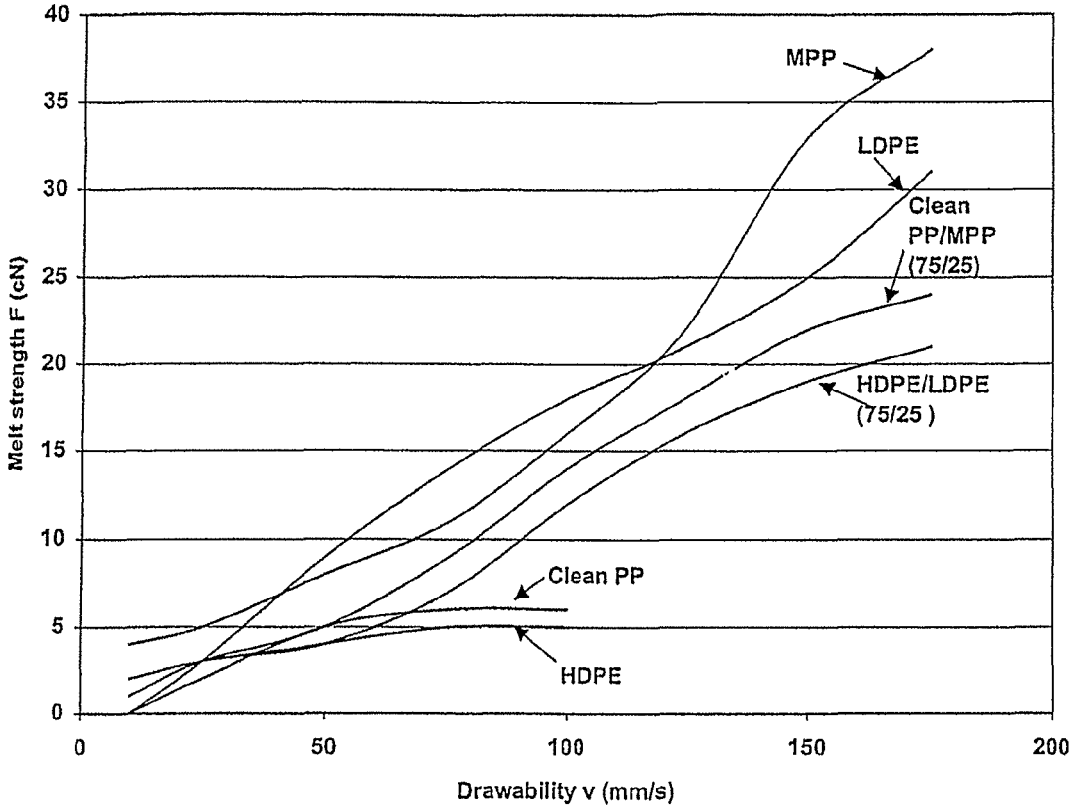
FIG. 4: shows a diagram showing melt strength vs. drawability curves of several polymers and polymer blends as used in the following examples.

From FIG. 4 it can be seen that MPP shows similar strain hardening behaviour as LDPE, and MDPE/HDPE show similar behaviour as clean PP.

3) Measurement of Electronic Properties

For measuring the electronic properties, square specimens with 9 cm×9 cm dimensions and a thickness of 4.0 mm were produced by press moulding of the polymer compositions with 15° C./min cooling in accordance to ISO 293-1986 (E).

The dielectric properties (dissipation, relative permittivity) have been measured using the split post resonator technique at a nominal frequency of 1.8 GHz.

Density as given in Table 1 was measured according to ISO 1872-2-B/ISO 1183D. Melt flow rate was measured according to ISO 1133 at a load of 2.16 kg at 230° C. for all polymer materials (PP and PE).

From Table 1 it can be seen that a mixture of MDPE+25 wt % LDPE has a dissipation factor of 118 whereas a blend of clean-PP and 25 wt % MPP shows a strongly reduced dissipation factor of 77.

TABLE 1

| Electrical measurements at high frequency | | | | |
|---|---|---|---|---|
| Polymer composition | Density (kg/m$^3$) | $MFR_2^{230° C.}$ | Dissipation factor Tan Delta at 1.8 GHz | Relative permittivity Epsilon at 1800 GHz |
| LDPE | 923 | 6 | 163 | 2.29 |
| MDPE | 936 | 4.8 | 116 | 2.32 |
| HDPE | 952 | 5.3 | 102 | 2.35 |
| MDPE + 25% LDPE | 932 | 5 | 118 | 2.3 |
| HDPE + 25% LDPE | 946 | 5.5 | 96 | 2.33 |
| Examples according to the invention | | | | |
| MPP | 910 | 2.5 | 128 | 2.26 |
| Clean PP | 910 | 3.7 | 60 | 2.25 |
| 15 wt % MPP + clean PP | 910 | 3.5 | 69 | 2.24 |
| 25 wt % MPP + clean PP | 910 | 3.4 | 77 | 2.25 |
| 35 wt % MPP + clean PP | 910 | 3.3 | 86 | 2.23 |
| 45 wt % MPP + clean PP | 910 | 3.2 | 95 | 2.25 |

The invention claimed is:

1. A coaxial or triaxial cable comprising a dielectric layer which comprises component (A) which is a propylene homo- or copolymer having strain hardening behavior with a haul-off force $F_{max}$>5 cN and a draw-down velocity $v_{max}$>150 mm/s, and component (B) which comprises a propylene homo- or copolymer having a catalyst residue of less than 50 ppm, an ash content below 100 ppm and a chloride content of less than 5 ppm.

2. Cable according to claim 1, wherein the propylene homo- or copolymer comprised in component (B) has a catalyst residue of less than 5 ppm, an ash content below 30 ppm, and a chloride content of less than 1 ppm.

3. Cable according to claim 1, wherein component (B) comprises at least 50 wt % of said polypropylene.

4. Cable according to claim 1, wherein the ratio of components (A):(B) is from 1:99 to 60:40.

5. Cable according to claim 1 wherein the propylene homo- or copolymer having strain hardening behavior with a haul-off force $F_{max}$>5 cN and a draw-down velocity $v_{max}$>150 mm/s has a melt flow rate of 0.1 to 25 g/10 min at 230° C./2.16 kg.

6. Cable according to claim 1 wherein the dielectric layer has been expanded.

7. Cable according to claim 6, wherein the degree of expansion is at least 60%.

8. Cable according to claim 1 wherein the dielectric layer further comprises a nucleating agent in an amount of 0.01 to 0.05 wt %.

9. A method for producing a dielectric layer of a coaxial or triaxial cable using a component (A) which is a propylene homo- or copolymer having strain hardening behavior with a haul-off force $F_{max}$>5 cN and a draw-down velocity $v_{max}$>150 mm/s and a component (B) which comprises a propylene homo- or copolymer having a catalyst residue of less than 50 ppm, an ash content below 100 ppm and a chloride content of less than 5 ppm.

* * * * *